US007273582B2

(12) United States Patent
Mordue et al.

(10) Patent No.: US 7,273,582 B2
(45) Date of Patent: Sep. 25, 2007

(54) SHAFT AND POST ASSEMBLIES FOR MOLTEN METAL APPARATUS

(75) Inventors: George S. Mordue, Ravenna, OH (US); Mark A. Bright, Sewickley, PA (US); Chris T. Vild, Cleveland Heights, OH (US); Richard S. Henderson, Solon, OH (US); Richard C. Chandler, Solon, OH (US)

(73) Assignee: Pyrotex, Inc., Spokane, WA (US)

( * ) Notice: Subject to any disclaimer, the term of this patent is extended or adjusted under 35 U.S.C. 154(b) by 0 days.

(21) Appl. No.: 11/120,061

(22) Filed: May 2, 2005

(65) Prior Publication Data

US 2005/0189684 A1 Sep. 1, 2005

Related U.S. Application Data

(60) Division of application No. 10/244,883, filed on Sep. 16, 2002, now Pat. No. 6,887,425, which is a continuation-in-part of application No. 09/436,014, filed on Nov. 9, 1999, now Pat. No. 6,451,247.

(60) Provisional application No. 60/107,701, filed on Nov. 9, 1998.

(51) Int. Cl.
*C21C 5/42* (2006.01)

(52) U.S. Cl. ..... 266/239; 266/286; 417/423.15

(58) Field of Classification Search ..... 266/239, 266/280, 286, 235; 417/423.15, 360
See application file for complete search history.

(56) References Cited

U.S. PATENT DOCUMENTS

| | | | | |
|---|---|---|---|---|
| 3,280,904 A | | 10/1966 | Hings | |
| 3,735,803 A | | 5/1973 | Arrington et al. | |
| 3,776,660 A | | 12/1973 | Anderson et al. | |
| 4,598,899 A | | 7/1986 | Cooper | |
| 4,898,367 A | | 2/1990 | Cooper | |
| 4,921,283 A | | 5/1990 | Schaffner et al. | |
| 4,941,692 A | | 7/1990 | Schaffner et al. | |
| 5,028,211 A | * | 7/1991 | Mordue et al. | 416/204 R |
| 5,558,505 A | | 9/1996 | Mordue et al. | |
| 5,685,701 A | * | 11/1997 | Chandler et al. | 266/235 |
| 5,944,496 A | | 8/1999 | Cooper | |
| 5,947,705 A | * | 9/1999 | Mordue et al. | 417/423.15 |

(Continued)

FOREIGN PATENT DOCUMENTS

EP 0 610 708 A1 8/1994

(Continued)

OTHER PUBLICATIONS

European Search Report dated Oct. 6, 2005.

*Primary Examiner*—Scott Kastler
(74) *Attorney, Agent, or Firm*—Fay Sharpe LLP

(57) ABSTRACT

An apparatus for moving a stream of molten metal comprising a pumping member, a housing at least partially enclosing the pumping member, a power device seated on a support, and a shaft connecting the power device and the pumping member. At least one post is disposed between the support and the housing. The post includes an elongated rod comprising a metal alloy surrounded by an outer sheath. An inner member may surround the rod and provide a molten metal resistant barrier. The rod includes a first end connected to the support and a second end secured to the housing. A similar design for a shaft is also provided.

6 Claims, 16 Drawing Sheets

U.S. PATENT DOCUMENTS

| | | | | |
|---|---|---|---|---|
| 6,051,183 | A | 4/2000 | Morando | |
| 6,250,881 | B1 * | 6/2001 | Mordue et al. | 415/200 |
| 6,358,467 | B1 * | 3/2002 | Mordue | 266/235 |
| 6,451,247 | B1 | 9/2002 | Mordue et al. | |

FOREIGN PATENT DOCUMENTS

| | | |
|---|---|---|
| WO | WO98/25031 | 6/1998 |
| WO | WO98/25031 | 7/1998 |

* cited by examiner

SHAFT AND POST ASSEMBLIES FOR MOLTEN METAL APPARATUS

This application is a divisional application of U.S. Ser. No. 10/244,883, filed Sep. 16, 2002, now U.S. Pat. No. 6,887,425, which is a continuation in part of U.S. Ser. No. 09/436,014 filed Nov. 9, 1999, now U.S. Pat. No. 6,451,247, which claimed priority to U.S. Provisional Application No. 60/107,701, filed Nov. 9, 1998.

BACKGROUND OF THE INVENTION

The present invention relates to an apparatus for degassing, submerging, agitating and pumping molten metal. Particularly, the present invention relates to a mechanical apparatus for moving or pumping molten metal such as aluminum, zinc or magnesium. More particularly, the present invention is related to a drive for such an apparatus in which a motor is positioned above a molten metal bath and rotates a vertical shaft. The lower end of the shaft drives an impeller or a rotor to impart motion to the molten metal. The middle portion of the assembly is supported by a steel shaft, which is reinforced by a ceramic post. The invention finds similar application in the construction of the post which supports the motor.

In the processing of molten metals, it is often necessary to pump molten metal from one place to another. When it is desired to remove metal from a vessel, a so-called transfer pump is used. When it is desired to circulate molten metal within a vessel, a so-called circulation pump is used. When it is desired to purify molten metal disposed within a vessel, a so-called gas injection pump is used. In each of these pumps, a rotatable impeller is submerged, typically within a pumping chamber, in the molten metal bath contained in the vessel. Additionally, the motor is suspended on a superstructure over the bath by posts connected to the base. In another embodiment of these pumps, a rotatable impeller can be submerged in the molten metal bath by a shaft affixed to a suspended motor, where the motor is not supported over the bath by any posts. Rotation of the impeller within the pumping chamber forces the molten metal as desired in a direction permitted by the pumping chamber design.

Mechanical pumps for moving molten metal in a bath historically have a relatively short life because of the destructive effects of the molten metal environment on the material used to construct the pump. Moreover, most materials capable of long term operation in a molten metal bath have relatively poor strength which can result in mechanical failure. In this regard, the industry has typically relied on graphite, a material with adequate strength, temperature resistance and chemical resistance, to function for an acceptable period of time in the harsh molten metal environment.

While graphite is currently the most commonly used material, it presents certain difficulties to pump manufacturers. Particularly, mechanical pumps usually require a graphite pump housing submerged in the molten metal. However, the housing is somewhat buoyant in the metal bath because the graphite has a lower density than the metal. In order to prevent the pump housing from rising in the metal and to prevent unwanted lateral movement of the base, a series of vertical legs are positioned between the pump housing and an overhead structure which acts simultaneously to support the drive motor and locate the base. In addition to functioning as the intermediate member in the above roles, the legs, or posts as they are also called, must be strong enough to withstand the tensile stress created during installation and removal of the pump in the molten metal bath.

Similarly, the shaft connecting the impeller and the motor is constructed of graphite. Often, this shaft component experiences significant stress when occluding matter in the metal bath is encountered and sometimes trapped against the housing. Since graphite does not possess as high a strength as would be desired, it would be helpful to reinforce the leg and shaft components of the pump.

A shaft or post assembly made entirely of ceramic would be brittle and subject to an unexpected failure. Furthermore, exposed metal components residing in the molten metal bath can dissolve.

In addition, graphite can be difficult to work with because graphite has different thermal expansion rates in its two grain orientations. This may result in a post and base having divergent and conflicting thermal expansion rates in the molten metal environment. This problem is compounded by the fact that pump construction has historically required cementing the graphite post into a hole in the graphite base. This design provides no tolerance between the components to accommodate this divergent thermal expansion. Unfortunately, this can lead to cracking of the base or the post. Accordingly, it would be desirable to have a molten metal pump wherein the mating of a post and a base is achieved in a manner which accommodates divergent thermal expansion tendencies.

The present invention is equally applicable to a variety of other apparatus used in processing molten metal. Moreover, in addition to pumps, molten metal scrap melting (i.e. submergence), degassing, and agitation equipment, typically rely on the rotation of an impeller/rotor submerged by a vertical shaft in a bath of molten metal. More specifically, a submergence device is used to help melt recycle materials. Two major concerns of the secondary metal industry are production rate and recovery or yield. Recovery is lowered by the generation of oxides and gasses which become entrained or dissolved into the molten metal during the melting of scrap metal. In addition to a loss in yield, entrained impurities decrease the quality and value of the scrap metal which is ultimately marketable as end product. Accordingly, a degassing device is often used to remove these impurities. In the degasser, a hollow shaft is typically provided to facilitate the injection of gas down the shaft and out through the bores in an impeller/shaft rotor. Typically, the introduced gasses will chemically release the unwanted materials to form a precipitate or dross that can be separated from the remainder of the molten metal bath.

An example of a submergence device is described in U.S. Pat. Nos. 4,598,899 and 6,071,024 herein incorporated by reference. An exemplary degassing apparatus is described in U.S. Pat. No. 4,898,367, herein incorporated by reference. In both devices, a vertically oriented shaft having an impeller/rotor disposed at one end in the molten metal bath is employed. Similar problems arise in these apparatus wherein the components are usually constructed of graphite, and would benefit from an increase in strength.

SUMMARY OF THE INVENTION

Accordingly, it is a primary advantage of the present invention to provide an apparatus for moving a stream of molten metal comprising a pumping member; a housing at least partially enclosing the pumping member; a power device seated on a support; a shaft connecting the power device and the pumping member; and at least one post disposed between said support and said housing, said post comprising an elongated rod surrounded by an inner member which is surrounded by a heat resistant outer member, said rod having a first end connected to said support.

It is a further advantage to provide a molten metal pump for moving a stream of molten metal comprising a pumping member; a housing at least partially enclosing the pumping member; a power device seated on a support; a shaft connecting the power device and the pumping member; and at least one post connecting said support and said housing, said post comprising an elongated rod surrounded by an inner member and an outer member, wherein said rod has one end secured to said housing, said end including a threaded portion attached to a cap, nut or bolt.

Another advantage of the present invention is to provide a molten metal pump comprising an elongated rod of a heat resistant alloy surrounded by an outer sheath of graphite with an inner sheath disposed between the outer sheath and the rod, wherein the ends of said rod extend outwardly from said inner and said outer sheath.

Yet another advantage of the subject invention is to provide a molten metal post comprising an elongated rod of heat resistant alloy supported by an inner member of a metal alloy, said inner member being surrounded by a plurality of generally cylindrical graphite, refractory or ceramic pieces.

Additional advantages of the present invention will be set forth in part in the description which follows and in part will be obvious from the description or may be learned by practicing the invention. The advantages of this invention may be realized and attained by means of the instrumentalities and combinations particularly pointed out in the appended claims.

To achieve the foregoing advantages in accordance with the purpose of the invention, as embodied and described herein, the molten metal pump of the present invention comprises a pumping member (such as an impeller or rotor), at least partially enclosed within a housing. A power device is seated on a support above the housing and pumping member. A shaft connects the power device and the pumping member to provide rotation thereof. At least one, and preferably two to four posts, suspend the housing from the support. One or both of the post or shaft is comprised of an elongated rod surrounded by a compressible inner member. In addition, the inner member and the rod are both surrounded by a sheath. The sheath can be heat resistant, molten metal resistant, corrosion resistant, and/or erosion resistant. In an embodiment of the post, the rod includes a first end attached to the support (directly or via a coupling) and a second end disposed within a cavity in the housing. Alternatively, the rod can be used strictly for compressing the outer member, which is coupled to the support. In an embodiment of the shaft, the rod includes a first end secured to the power device (directly or via a coupling) and a second end disposed within a cavity in the pumping member. It is also noted that the shaft embodiment is further suited to use in submergence, degassing and agitation devices as well as suspended pump applications having no post assemblies, only a shaft connecting the motor to the impeller.

Preferably, the outer sheath is comprised of a graphite, refractory, or ceramic material and the housing is comprised of graphite. The inner member is preferably a compressible ceramic. The compressible ceramic material can be granular, powdered or another type. The material can be poured into a void between the outer sheath and the rod, the ceramic material can be attached to the rod or the sheath as well. Preferably, the rod will be comprised of a heat resistant alloy.

In a particularly preferred form of the post embodiment, the rod is biased by a spring. Preferably, the outer member abuts a bottom surface of the support (or an intermediate coupling) and a top surface of the housing and the biasing force of the spring create a compressive force on the outer member.

In a particularly preferred form of the invention, the outer sheath is comprised of a plurality of generally cylindrically shaped units, aligned along their longitudinal axis to provide a stacked arrangement. The inner member can run down a central bore of each unit. Preferably, the lower most unit will include a circumferential protrusion shaped to mate with a recess formed in the top surface of the housing to create a fluid tight seal.

The invention may take form in a molten metal pump post having an elongated rod of heat resistant alloy; a sheath member, wherein a first end and a second end of the rod extend outwardly from the sheath; and a coupling unit surrounds and is secured to a first portion of the sheath member proximal the rod first end.

The invention may take form in a molten metal pump post comprising an elongated rod of heat resistant alloy; a sheath member at least partially surrounding the rod; a heat resistant material interposed between the rod and the sheath; and a coupling unit secured to a first end of the rod.

The invention may also take form in an assembly for attaching an associated molten metal pump post to a component of a molten metal pump. The assembly may comprise a generally cylindrical member having a first open end that accommodates an elongated refractory element and an opposed end including spring elements, wherein a bore extends the length of said member.

The invention may take form in an assembly for biasing a molten metal pump post. The pump post may comprise a hollow biasing member having a central opening and a cup-shaped member disposed at an end of and axially aligned with the biasing member.

The invention may also include a molten metal pump post comprising an elongated rod of heat resistant alloy surrounded by a contiguous sheath having at least one tapered end comprising graphite, ceramic or refractory material, wherein the ends of the rod extend outwardly from the sheath.

The invention may also include an assembly for biasing an associated molten metal pump post comprising an elongated rod surrounded by a protective sheath. The assembly may comprise a hollow biasing member comprising an aperture shaped to receive the rod, a first end and a second end; a cup-shaped member positioned at the second end of the biasing member and axially aligned with the biasing aperture, the cup-shaped member comprising an open end distal the biasing member second end and a substantially closed end proximal the biasing member second end, wherein the open end is shaped to receive the post including the protective sheath and the substantially closed end comprises an opening shaped so that the elongated rod can pass through; a clamping member at least partially surrounding the cup-shaped member; and a bracket spanning the biasing member, the bracket fastened at a first end to the rod proximal the biasing member first end and fastened at a second end to the clamping member.

The invention may further include a molten metal pump post comprising an elongated rod of a heat resistant alloy; a protective sheath surrounding the elongated rod; an indicating device having a terminal disposed in the molten metal bath; and an indicating terminal positioned between the rod and the protective sheath, the indicating terminal being electrically connected at one end to the indicating device whereby upon penetration of molten metal through the protective sheath a circuit closes charging the indicating device.

The invention may also include a method for determining penetration of molten metal through a protective shield of a molten metal pump post. The method may comprise surrounding a rod of the molten metal pump post with the protective shield; placing the rod and protective shield in an associated metal bath; interposing an indicating terminal between the rod and the shield; electrically connecting the indicating terminal to an indicating device; and positioning a second terminal in the associated molten metal bath and electrically connecting the second terminal to the indicating device.

The invention may also take form in a base assembly for an associated molten metal pump comprising a pumping member and a molten metal pump post having an elongated rod having a cap at the end surrounded by a protective sheath. The base may comprise a housing comprising a lateral side, the housing defining a first cavity extending through the housing and a second cavity coaxial with the first, wherein the housing at least partially encloses the pumping member and the cavities are accessible from the lateral side of the housing.

The invention may also take the form of a molten metal pump having the base assembly described in the preceding paragraph and further including a post having a metal rod surrounded by a refractory sheath, the sheath forming a fluid-tight seal with an upper surface of the base; and the rod including an end disposed in the base, the end surrounded by a refractory member.

The invention may also include an apparatus for moving a stream of molten metal. The apparatus includes a pumping member; a housing at least partially enclosing the pumping member; a power device seated on a support; a shaft connecting the power device and the pumping member; and at least one post disposed between the support and the housing, the post comprising an elongated rod surrounded by an inner member that is surrounded by a heat resistant outer member, the rod having a first end connected to the support and a second end secured within a cavity in the housing.

Additionally, the invention may include a method of manufacturing a part for a molten metal pump comprising providing a fixture suited for holding a metallic rod in a generally upright orientation, placing a refractory sheath around the rod, cementing a metallic cap to the refractory sheath at a distal end from the fixture, wherein the sheath is held in place during the cementing step.

The invention may further include a molten metal pump post comprising a first metal elongated rod; a second elongated rod releasably attached to said first elongated rod; and a sheath member at least partially surrounding at least one of said first and second elongated rods.

The invention may also include a molten metal pump post comprising an elongated rod; a sheath at least partially surrounding said elongated rod; and a coupling unit at least partially surrounding and secured to a first portion of said sheath member.

BRIEF DESCRIPTION OF THE DRAWING(S)

The invention consists in the novel parts, construction, arrangements, combinations and improvements as shown and described. The accompanying drawings, which are incorporated in and constitute part of the specification illustrate one embodiment of the invention and, together with the description, serve to explain the principles of the invention. Of the drawings.

Figure 13:
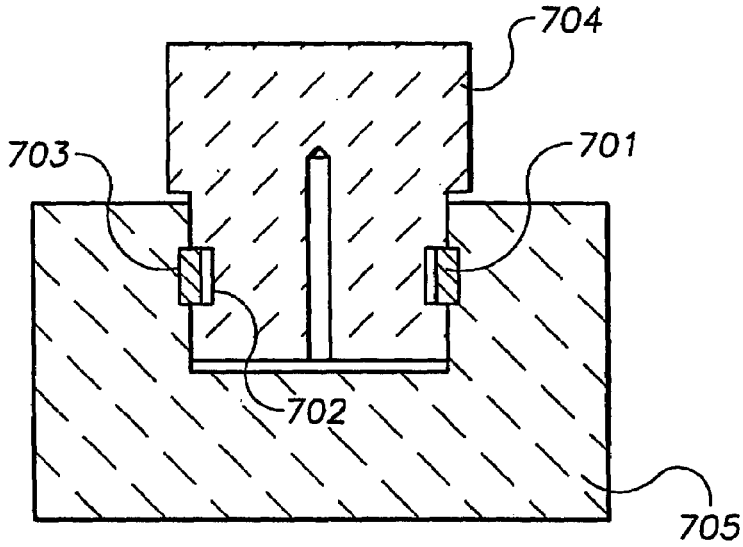
Figure 14:
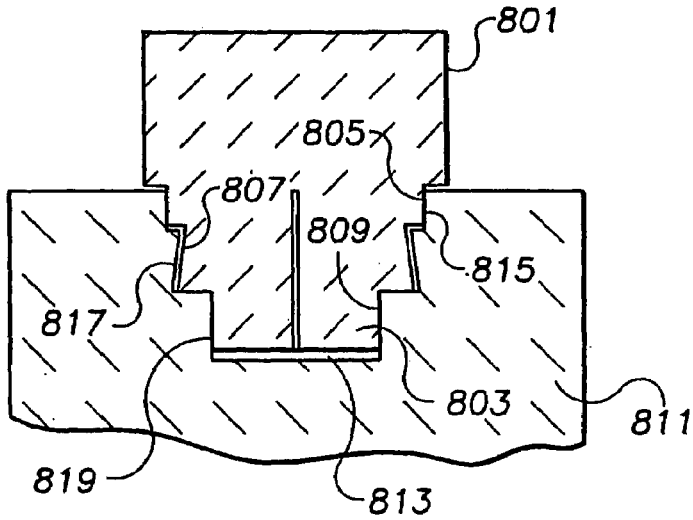
Figure 16:
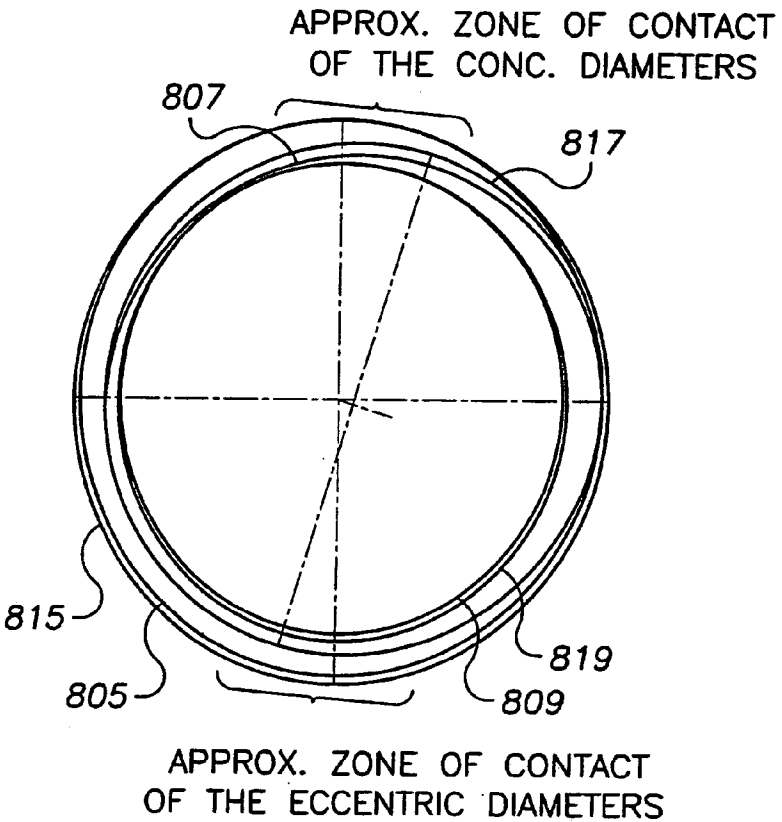
Figure 15:
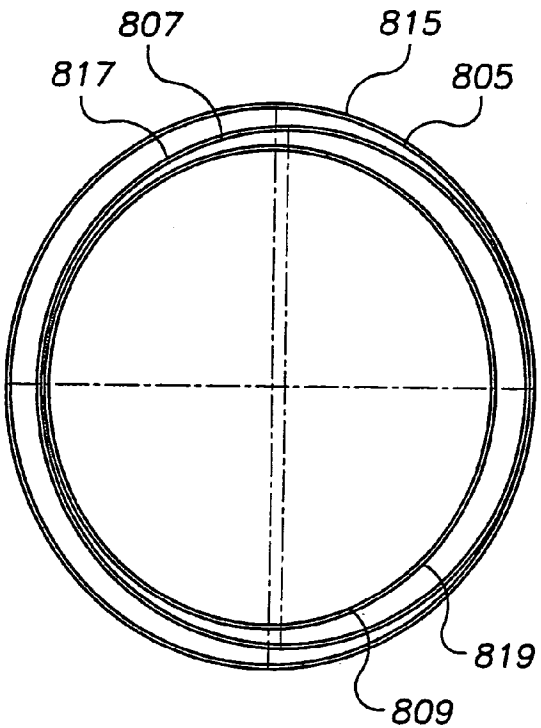
Figure 17:
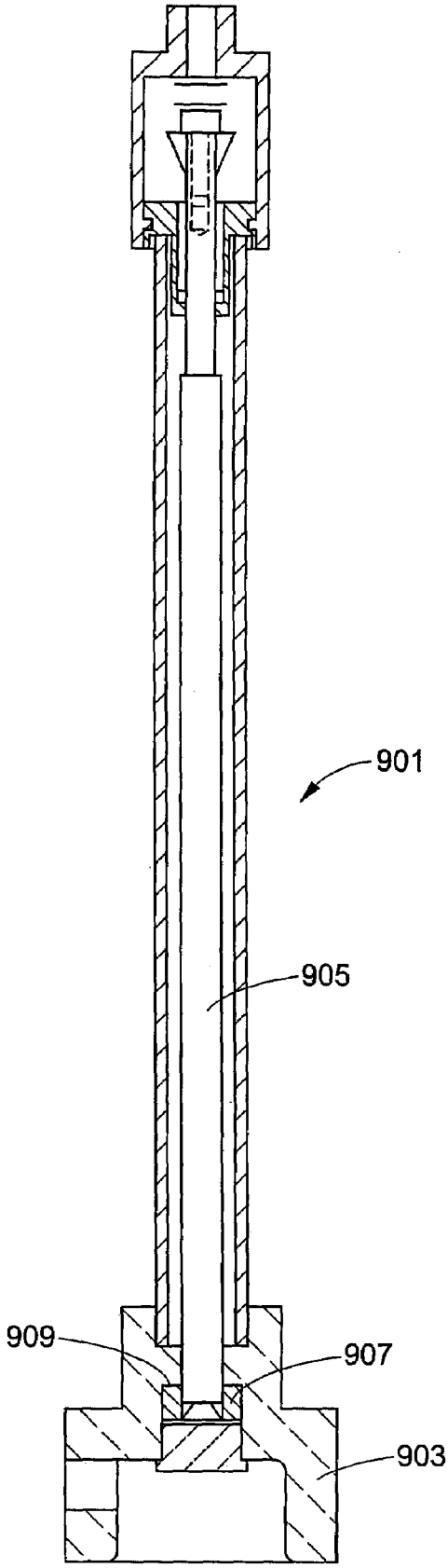
Figure 18:
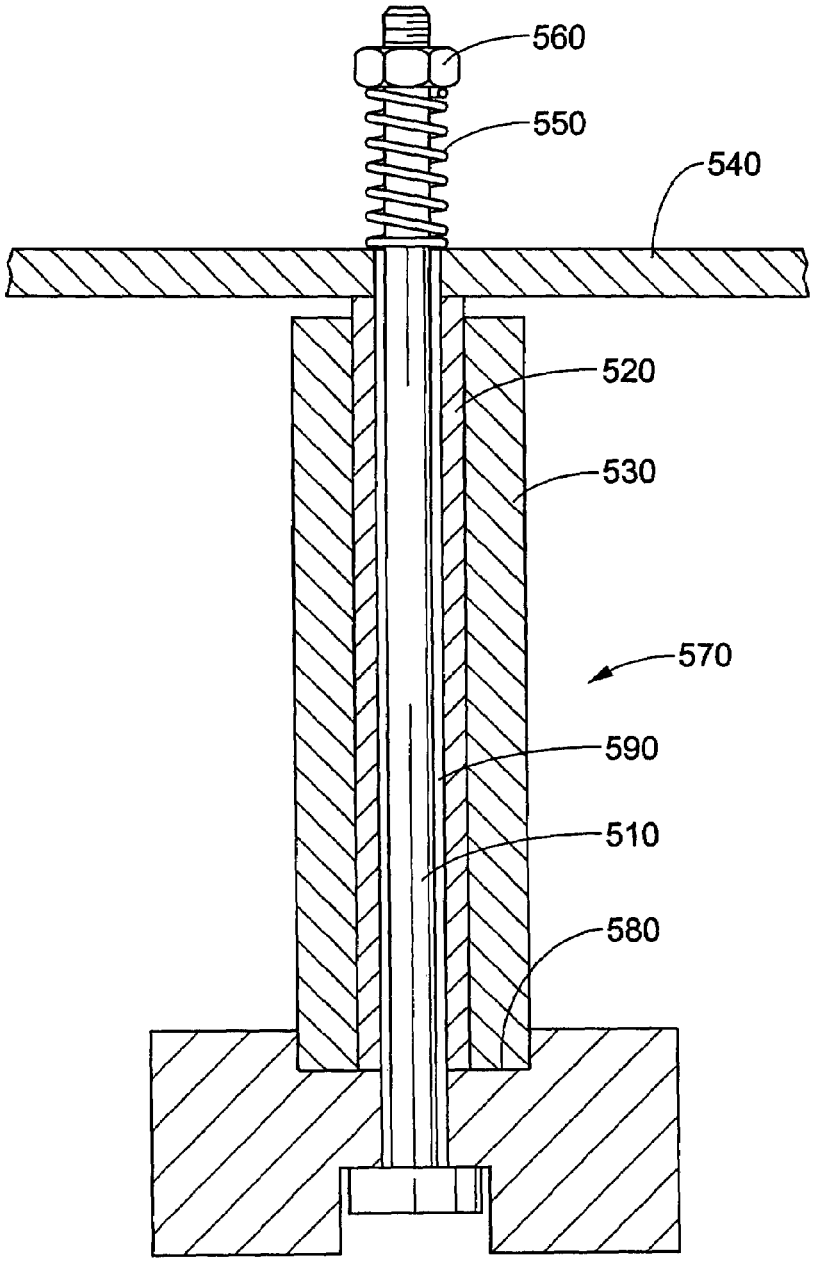
Figure 19:
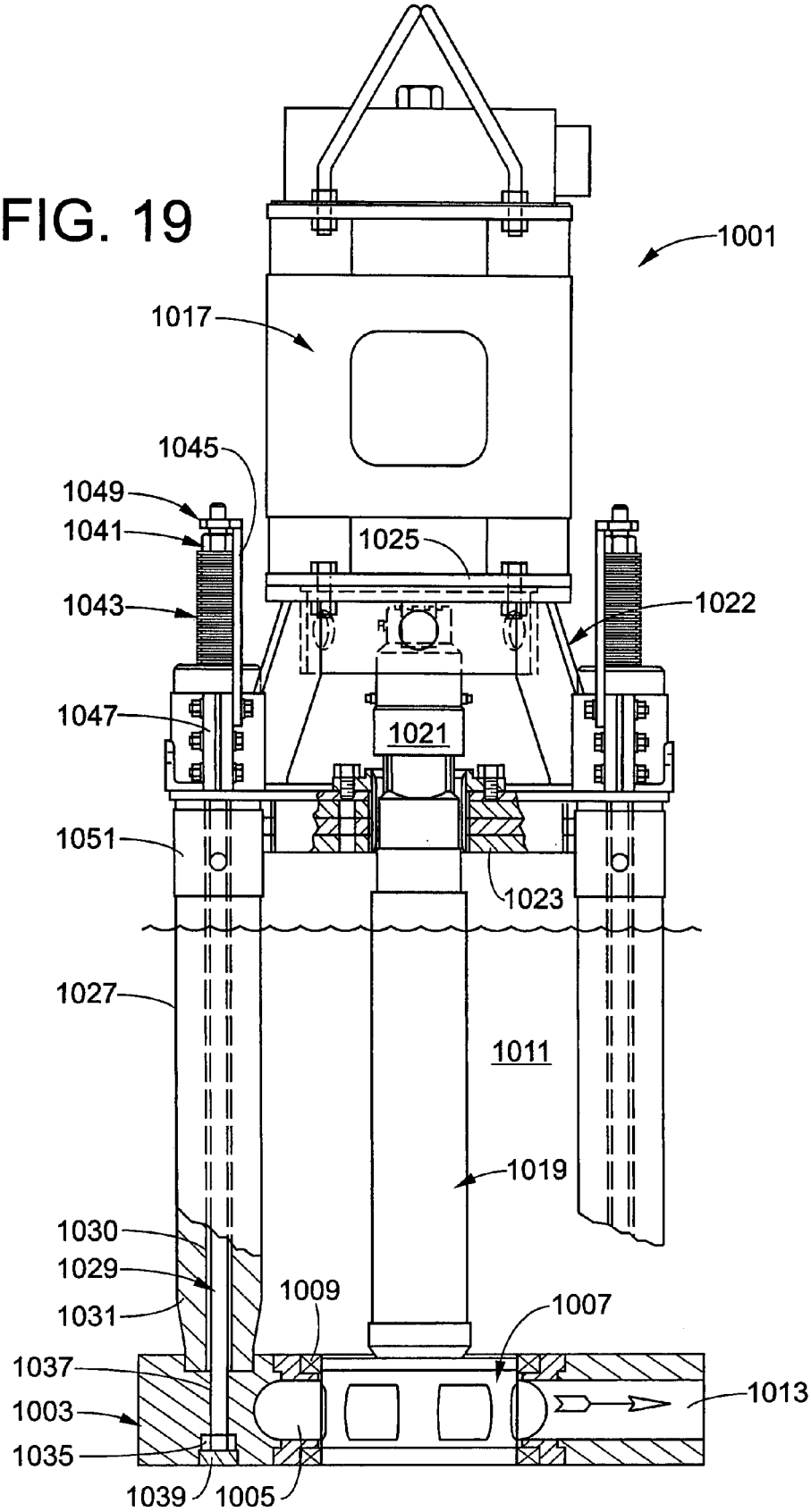
Figure 20:
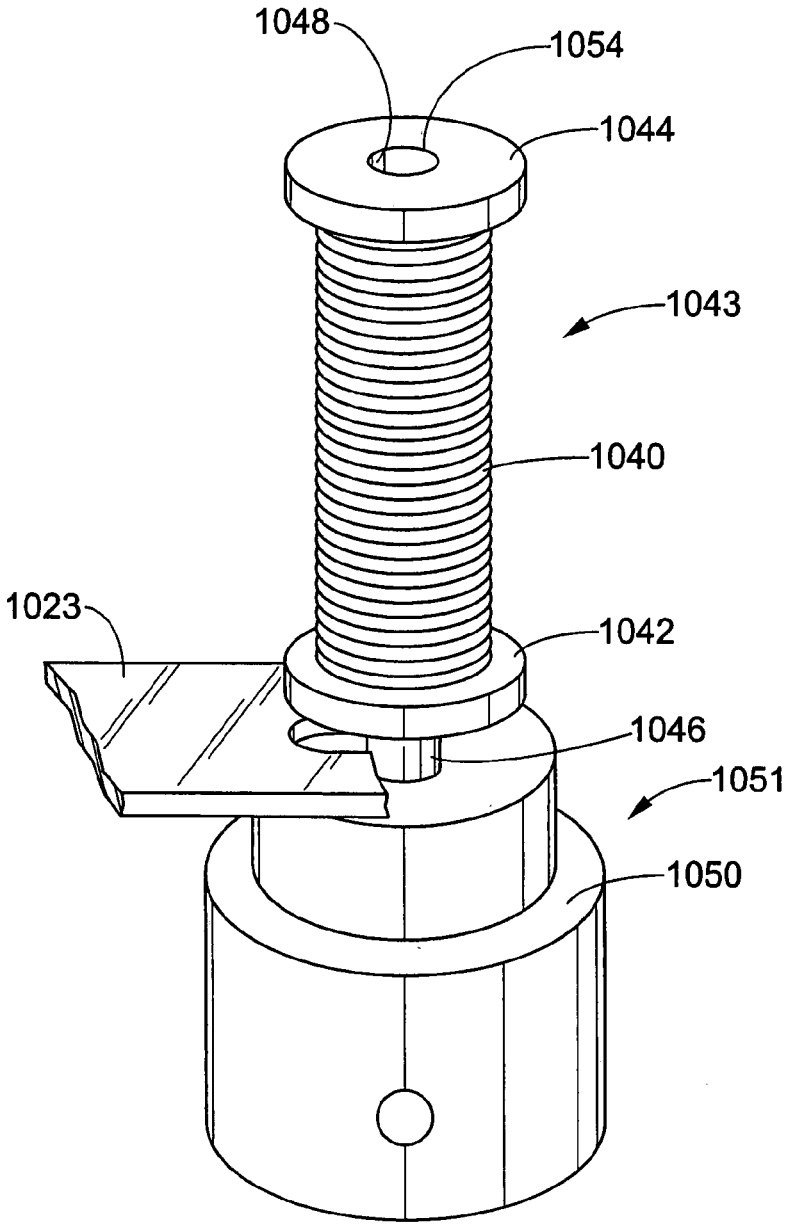
Figure 21:
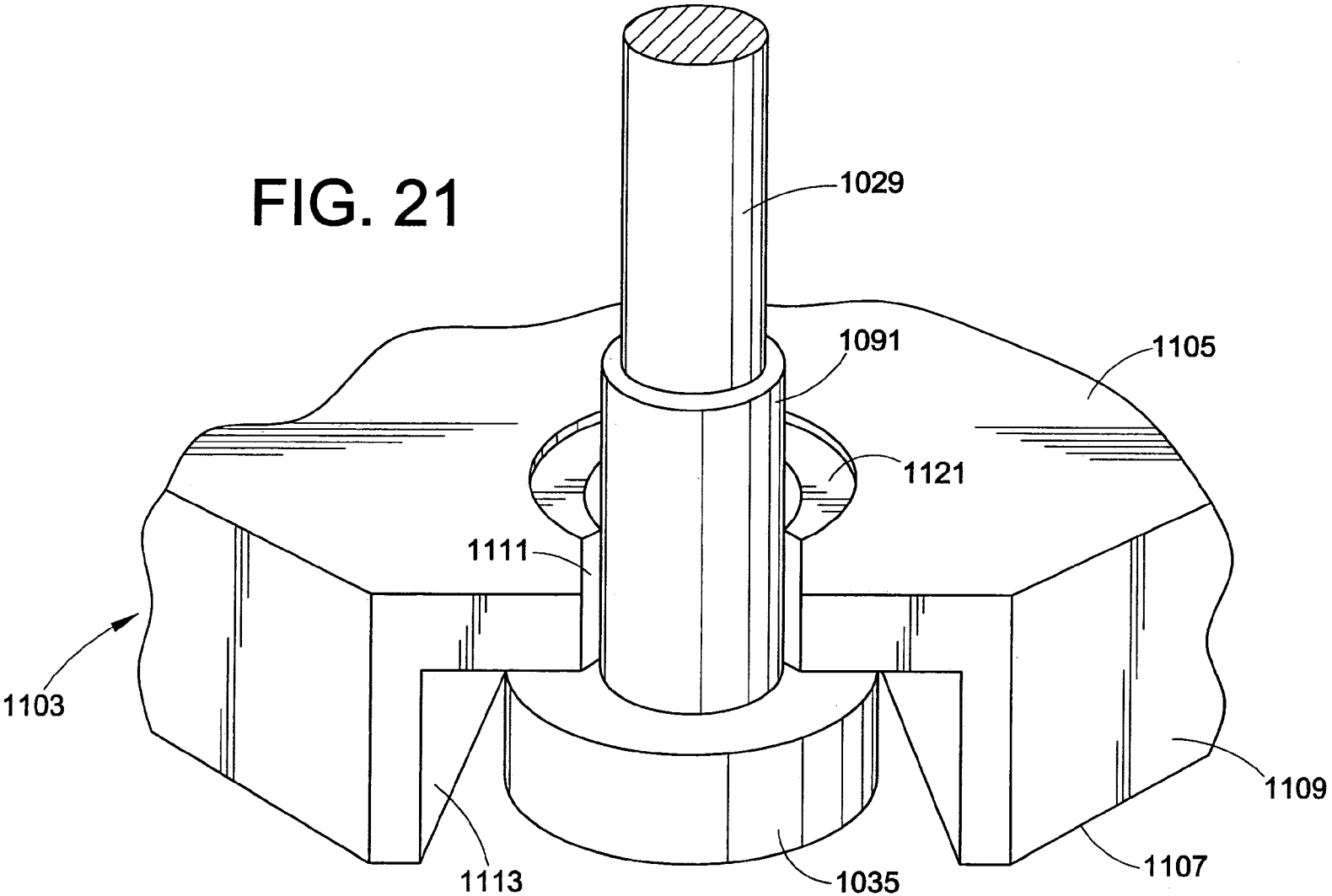
Figure 23:
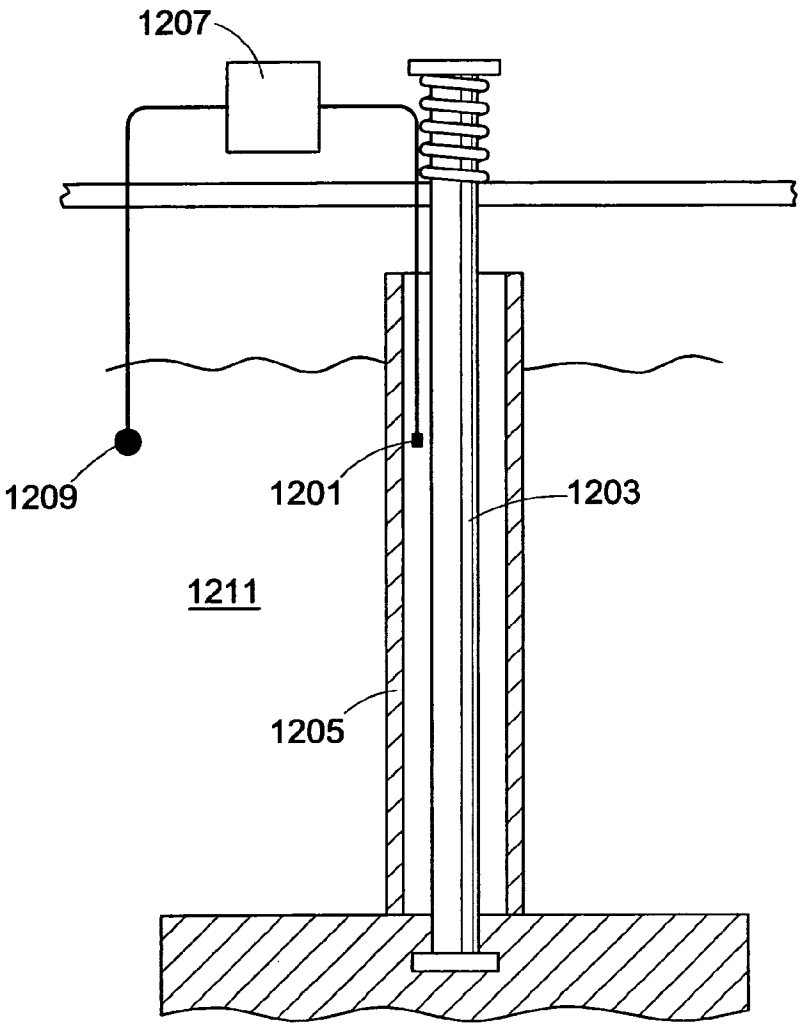
Figure 22:
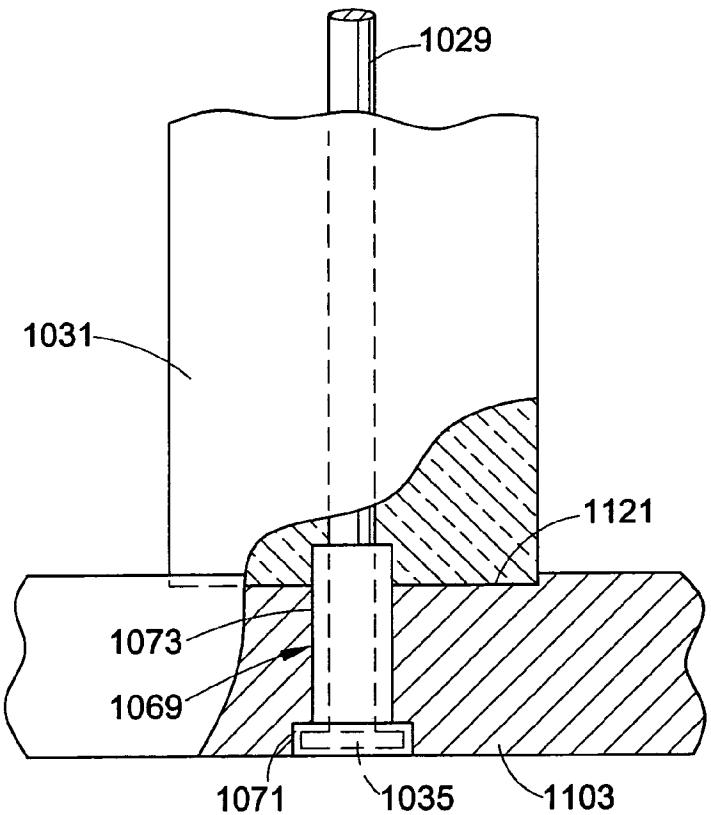
Figures 24, 25:
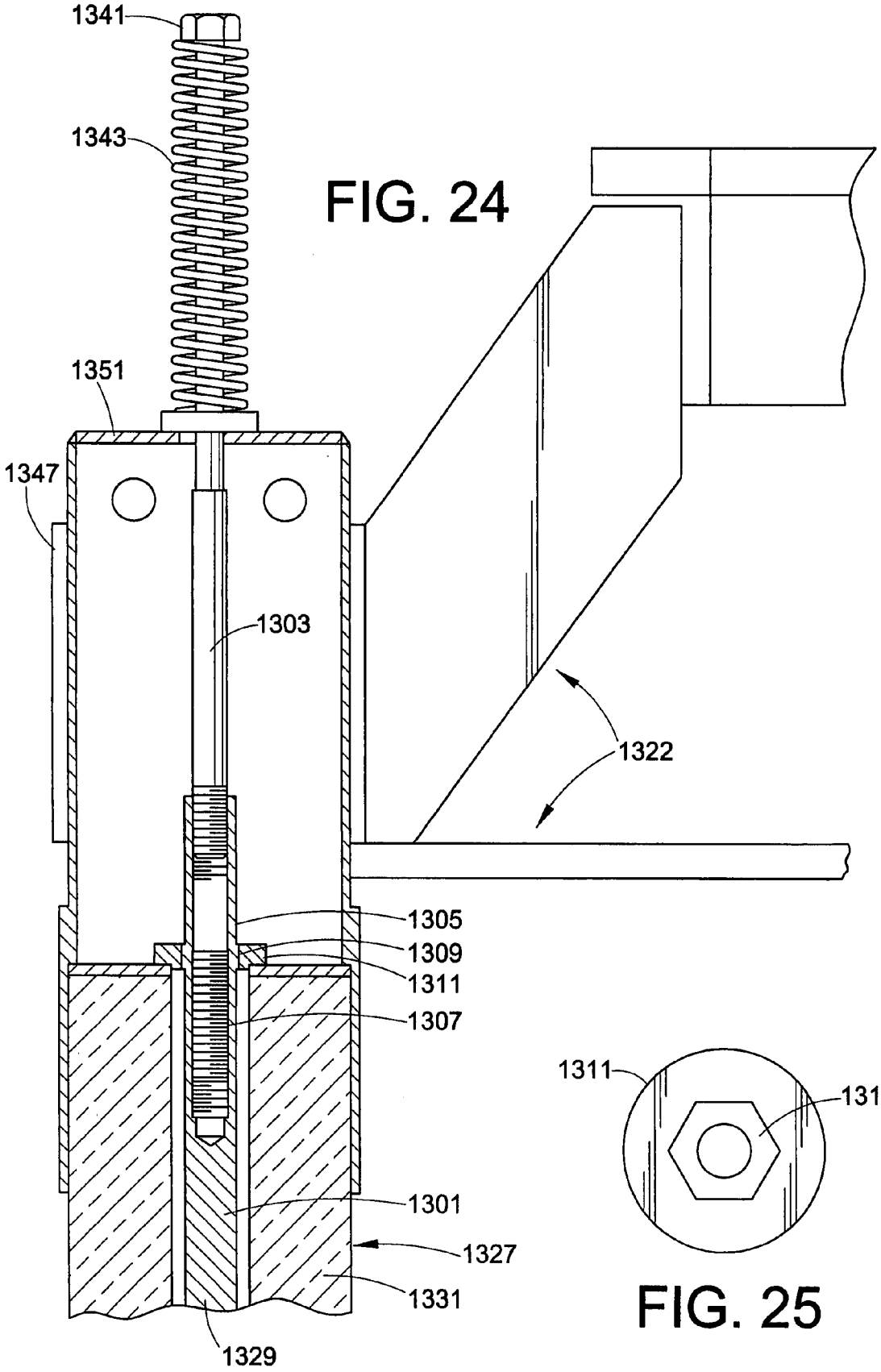

FIGS. 13 and 14 provide alternative base and post joining mechanisms;

FIG. 15 is a top view of the base and post of FIG. 14 with their eccentric diameters aligned to allow insertion of post into base;

FIG. 16 is a top view of the base and post of FIGS. 14 and 15 with the post rotated to misaligned diameters to achieve a locking arrangement;

FIG. 17 is a front elevation view, partially in cross-section, of a shaft impeller arrangement of the present invention;

FIG. 18 is a front elevation view, in cross-section, of an alternative post embodiment in accordance with one aspect of the present invention;

FIG. 19 is a front elevation view, partially in cross-section, of a molten metal pump in accordance with another aspect of the present invention;

FIG. 20 is an perspective view of an alternative fastening/biasing assembly for the post;

FIG. 21 is a perspective view of an alternative base assembly;

FIG. 22 is a front elevation view of the base assembly FIG. 21 with a rod having an outer sheath;

FIG. 23 is a schematic view of an alternative post embodiment in accordance with one aspect of the present invention;

FIG. 24 is a partial front elevation view, partially in cross-section, of a molten metal pump in accordance with another aspect of the present invention;

FIG. 25 is a top view of a portion of a coupling unit of FIG. 24.

DETAILED DESCRIPTION OF THE PREFERRED EMBODIMENT(S)

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
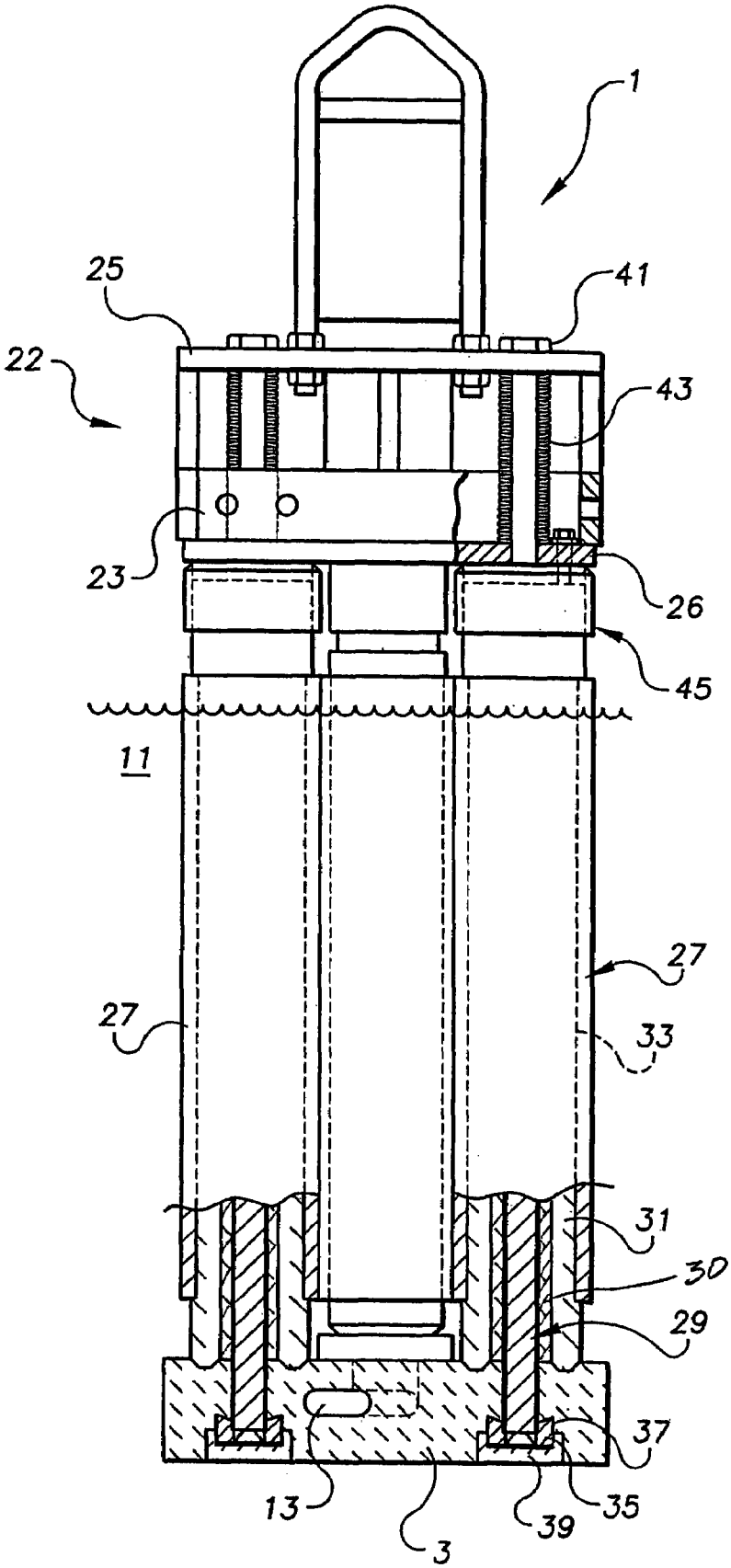
FIG. 1 is a front elevation view, partially in cross-section, of a molten metal pump in accordance with one aspect of the present invention.
Figure 2:
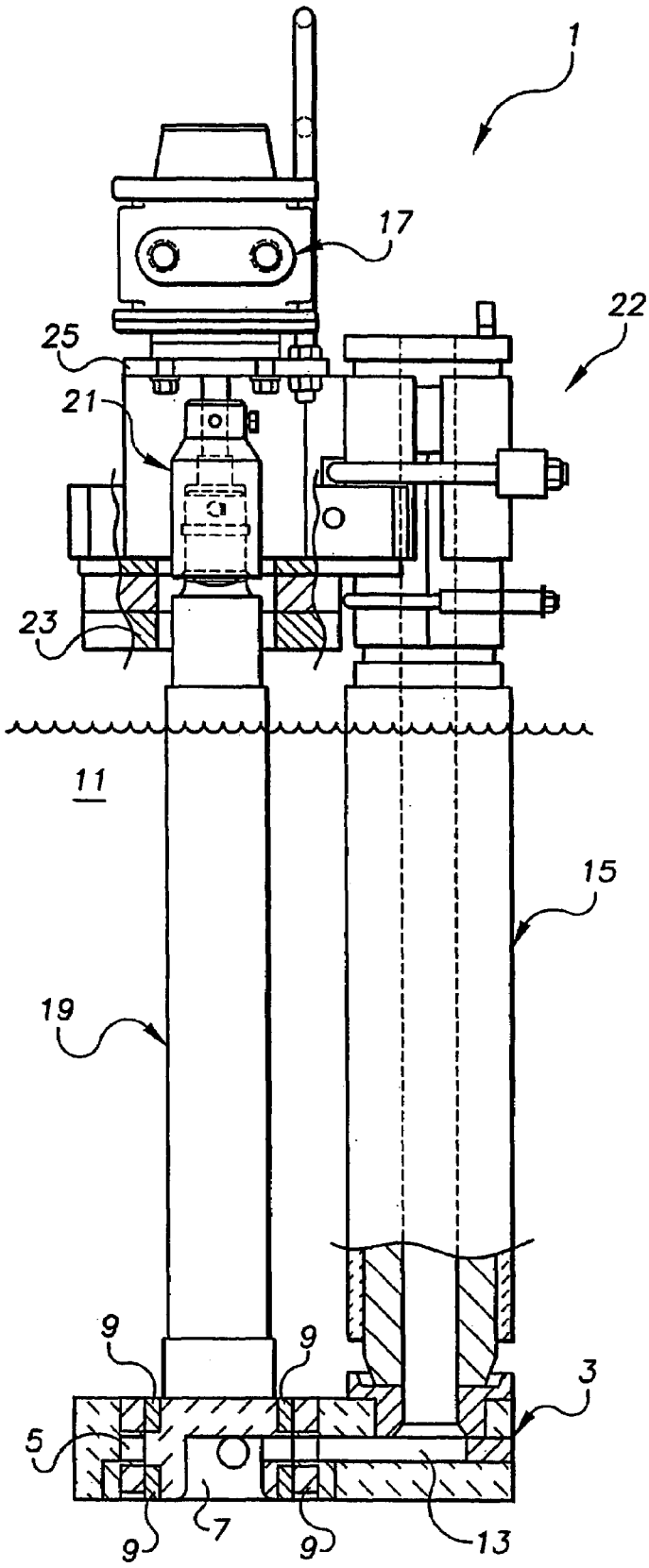
FIG. 2 is a side elevation view, also partially in cross-section, of FIG. 1.

Referring now to FIG. 1, a molten metal transfer pump 1 is provided. The molten metal pump 1 includes a base assembly 3 having a pumping chamber 5 with an impeller 7 disposed therein. Bearing rings 9 provide mating surfaces between the impeller 7 and the base assembly 3. Rotation of the impeller 7 forces molten metal 11 through outlet 13 and up riser tube 15 for transport to another location.

Rotation of impeller 7 is achieved when motor 17 rotates shaft 19 by turning shaft coupling 21 provided therebetween. The motor 17 is positioned above the base assembly 3 on a platform assembly 22 having an insulation layer 23, a motor mount bracket 26 and a motor mount plate 25.

In a preferred embodiment as depicted in FIG. 1, two post assemblies 27 are shown. However, any number of post assemblies could be used in the present invention, preferably one, two or four. Most preferably, two post assemblies 27, comprised of a rod 29 constructed of a heat resistant alloy material disposed within an inner member 30 and an outer sheath 31 suspend the base assembly 3 below the platform 22. The inner member 30 is disposed between the rod 29 and the outer sheath 31. The inner member can be a material to wet out molten metal that may penetrate the outer sheath. The inner member can comprise fiberfrax, graphoil or other similar material, including but not limited to compressible ceramics.

Preferably, the rod will be constructed of an alloy such as MSA 2000 or MSA 2001 available from Metaullics Systems Co., L.P. 31935 Aurora Road, Solon, Ohio, 44139. The outer sheath 31 includes a ceramic shield for additional protection against oxidation, erosion, corrosion, etc. The lower end of rod 29 includes cap 35. Cap 35 is disposed within a cavity 37 in base assembly 3. A graphite or refractory plug 39 is cemented into the lowermost portion of the cavity 37 to seal the area from molten metal. Plug 39 is such that its diameter is sufficiently large to include the rod 29 and both the inner member 30 and outer sheath 31, while still sealing the connection within the housing. The upper end of the rod 29 extends through the insulation layer 23 and is secured with nut 41 to motor mount plate 26. A disc spring 43 or other compression spring is disposed between the motor mount platform 25 and insulation layer 23. Preferably, an insulating washer (not shown) will be positioned between motor mount plate 26 and spring 43. Tightening of nut 41 results in compression of the spring 43 and a bias on the rod 29 and inner 30 and outer 31 sheaths.

Advantageously this assembly provides a high strength alloy rod connection between the base and motor mount. The alloy rod is further supported by steel alloy sleeve, which surrounds the alloy rod. In addition to the steel alloy sleeve, the assembly protects the otherwise degradable rod from the molten metal environment by surrounding the alloy rod and steel alloy sleeve with a ceramic post. A further advantage is that the thermal expansion mismatch resulting from divergent grain orientations in a graphite post and a graphite base is eliminated because a graphite post is not rigidly cemented into a hole in the base. Furthermore, the strength of the graphite sheath is increased because it is retained under compression as a result of being squeezed between socket 45 and the upper surface of base assembly 3.

Figure 3:
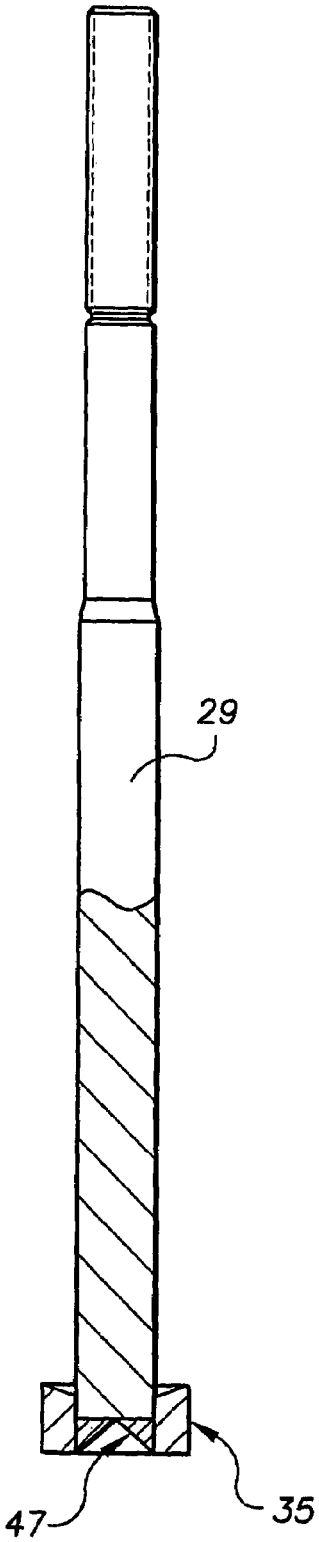
FIG. 3 is a front elevation view, partially in cross-section, of the rod of FIG. 1.
Figure 4:
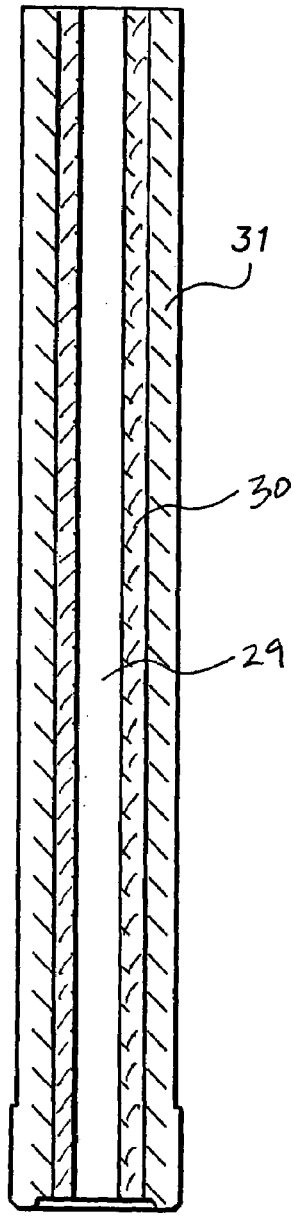
FIG. 4 is a front elevation view, in cross-section, of the outer sheath of FIG. 1.

Turning now to FIG. 3, a detailed depiction of rod 29 is provided. In this embodiment, cap member 35 is welded at weld lines 47 to the lower most end of the rod. Of course, other mechanisms of attachment, including but not limited to, threaded or swaged, are appropriate joining techniques. FIG. 4 provides a detailed cross-sectional view of rod 29 surrounded by inner sheath 30 and outer sheath 31.

Figure 5:
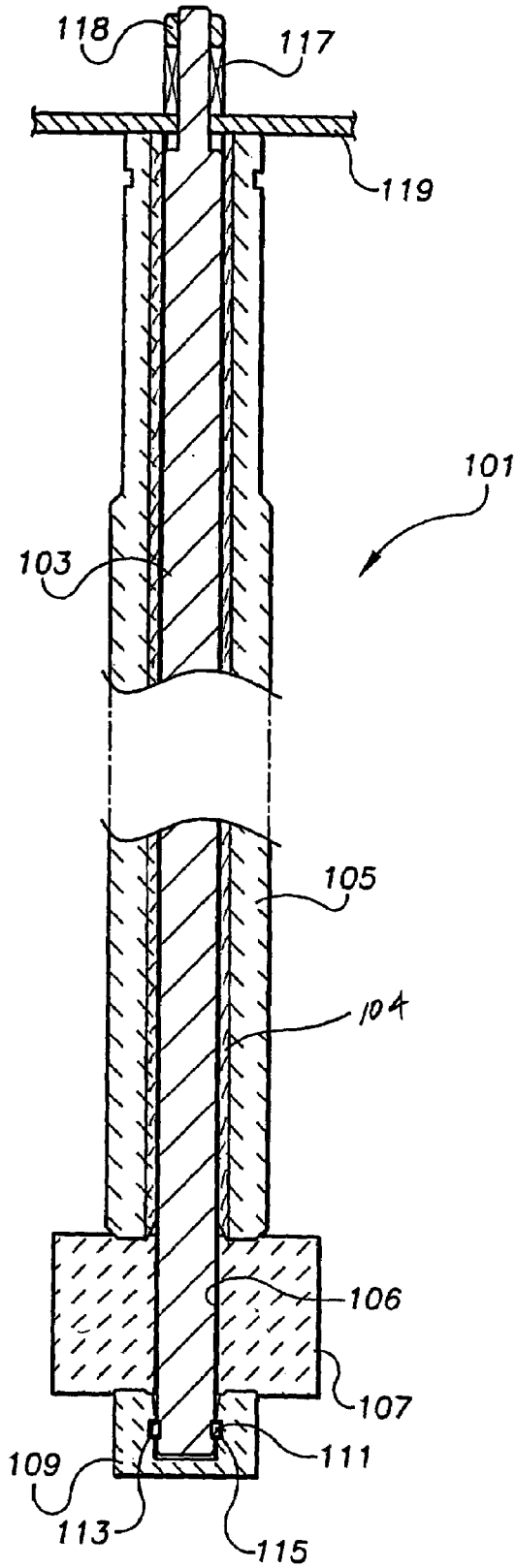
FIG. 5 is a front elevation view, in cross-section, of an alternative post embodiment.

Referring now to FIG. 5, an alternative post embodiment is depicted. In this embodiment, the post 101 again includes rod 103 protected from the molten metal environment by inner member 104 and an outer sheath 105 comprising an insulating material such as ceramic. Rod 103 passes through a bore/cavity 106 in a base member 107 and is retained by the cap 109 containing a snap ring 111 having corresponding retaining grooves and in the cap 109 and rod 103, respectively. Again a disk spring 117 and nut 118 are provided, which in concert with the platform 119 create a bias on rod 103 and a compressive force on the inner 104 and the outer 105 sheath.

Figure 6:
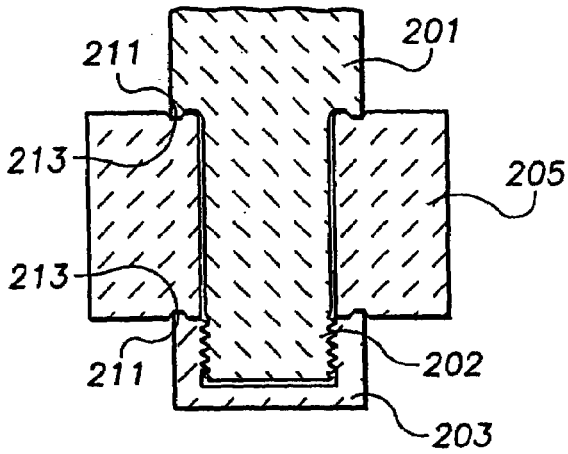
FIGS. 6, 7 and 8 are front elevation views, in cross-section, of alternative post and base seating arrangements.
Figure 7:
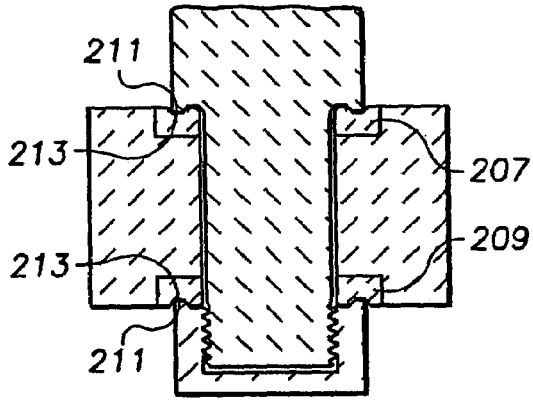
Figure 8:
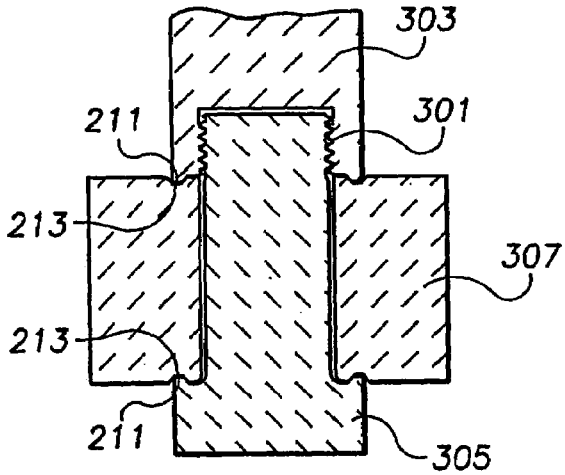

Turning now to FIGS. 6, 7, and 8, alternative post and base joining techniques are depicted. For example, in FIG. 6, rod 201 extends through base 205 and includes a threaded end 202 on which graphite cap 203 is secured. In FIG. 7, the embodiment of FIG. 6 is modified to include seal members 207 and 209 constructed of boron nitride, silicon carbide, or other suitable material. In FIG. 8, an alternative embodiment is depicted wherein a threaded bore 301 is provided in the end of graphite post 303 and a threaded graphite post 305 extends upwardly through base member 307 and is mated to the end of the post 303. An advantage of each design is the ability to create a tension on the post to provide a self-alignment mechanism without the need for a structural use of cement. In this regard, a thermal expansion gap can be provided (see FIG. 11) where cement has been historically required. This gap preferably contains a fiber filler, for additional support and thermal resistance.

Furthermore, the use of a protrusion 211 on the end cap post/bolt 203/305 in combination with recesses 213 on the top and bottom surfaces of the base 205/307 creates a fluid tight joint. Accordingly, molten metal does not enter this joint, allowing the post to be removed from the base if a rebuild of the pump is required.

It should be noted that while the present joining mechanisms in FIGS. 6 through 8 are generally depicted as coinciding to the utilization of a steel alloy rod, these mechanisms for joining a post to a base are equally applicable to a graphite post arrangement. Moreover, the arrangements depicted in FIGS. 6 through 8 can equally be considered as being constructed of all elements comprised of a combination of steel and graphite/ceramic or graphite/ceramic alone. An advantage provided by these assemblies is that there is no necessity for a cement joint between the post and the base which better accommodates thermal expansion mismatches.

Figure 9:
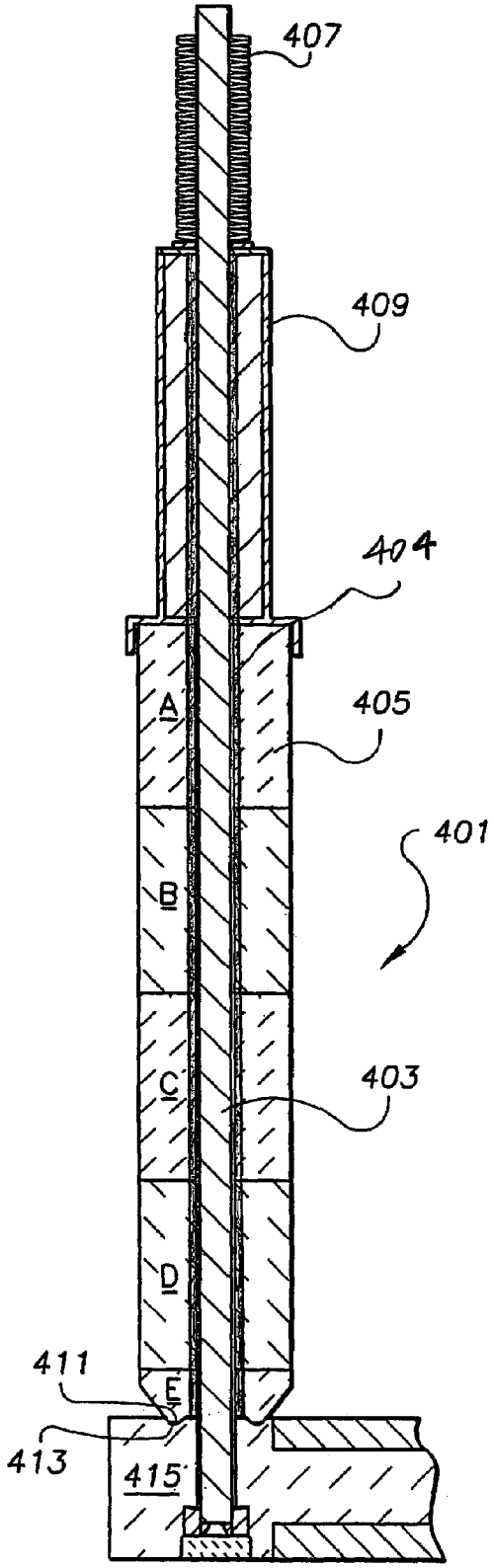
FIG. 9 is a front elevation view, in cross-section, of a segmented post design.

Turning now to FIG. 9, an alternative embodiment of the present invention is provided wherein the post 401 includes a rod 403 and an inner member 404 and an outer sheath 405. However, in this embodiment the outer sheath 405 is comprised of a plurality of segmented units (A-E). This design is particularly desirable because of the relative ease of forming individual segmented units as opposed to an elongated tube. Again, the post 401 is provided with a spring 407 and a metallic coupling unit 409, which in combination with the motor mount (not shown) creates a compressive force on the sheath segments (A-E). A fluid tight seal is created between each of the individual units as a result of the compressive force and, may be enhanced by the inclusion of a gasket material (not shown) therebetween. The lower most unit of the segmented outer sheath (E) includes a circumferential protrusion 411 which is seated in a recess 413 in the top surface of the base 415 and surrounds the inner member 404, which surrounds the rod 403. Accordingly, a fluid tight seal is achieved. As in any of the other designs herein, a bead of cement or sealant may be placed around the seated protrusion 411 to further protect against unwanted metal seepage.

Figure 10:
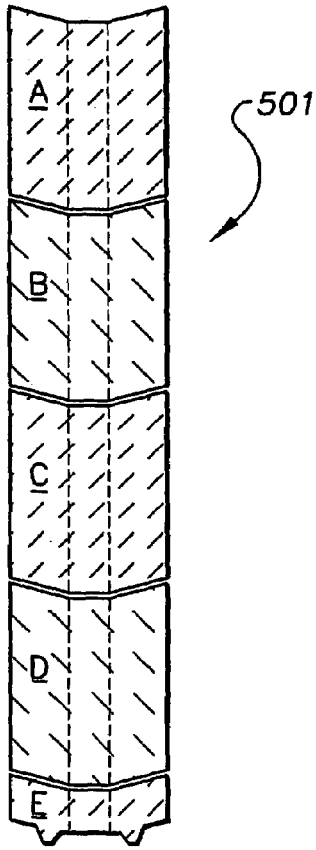
FIG. 10 is a front elevation view, in cross-section, of an alternative segmented sheath design.

Referring now to FIG. 10, an alternative embodiment of a segmented sheath 501 is depicted. In this embodiment, the end surfaces of the individual units A-E are cooperatively contoured to facilitate achieving an appropriate mating arrangement. In this regard, a verifiable seating arrangement is provided to assure a metal tight seal is formed between each individual segment.

Figure 11:
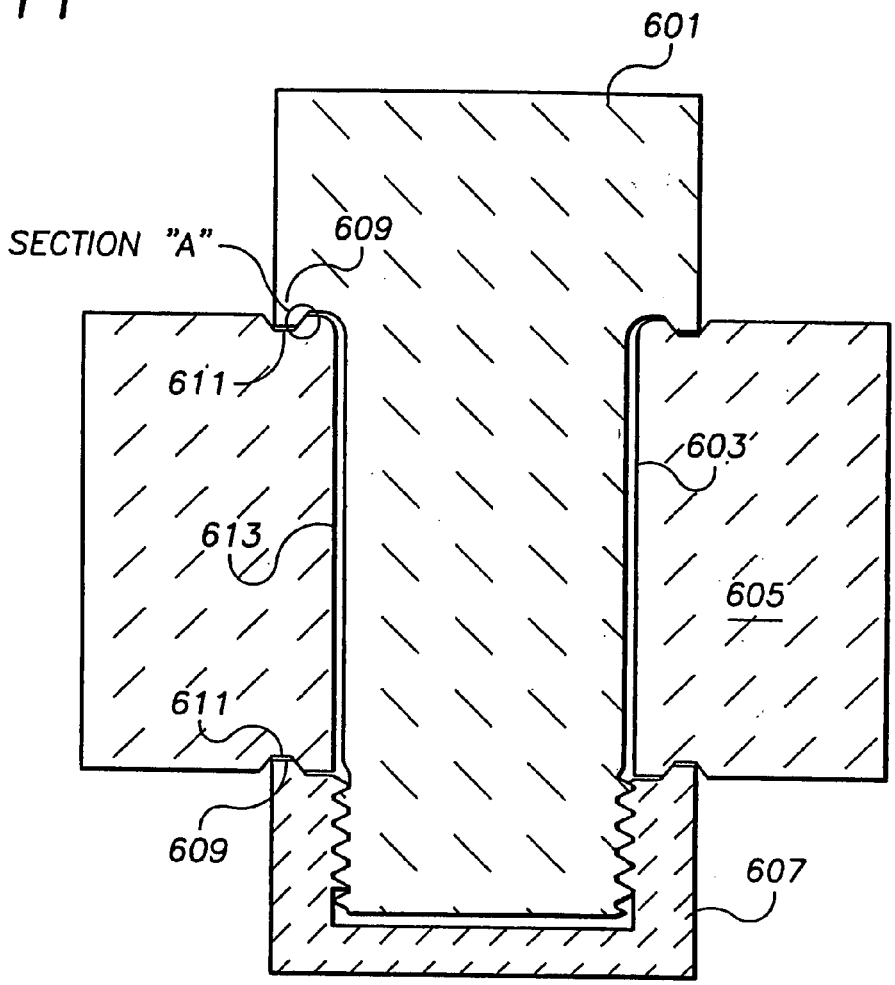
FIG. 11 is an exploded side elevation view, in cross-section, of an alternative post/base joining arrangement.

Turning now to FIG. 11, a detailed view of an arrangement mating a graphite post to a graphite base is provided to demonstrate both the desired tolerance for thermal expansion and a desirable configuration for achieving a fluid tight seal. More particularly, graphite post 601 passes through a hole 603 in a base assembly 605. Threaded graphite cap member 607 is attached to the lowermost portion of post 601. At both of the top and bottom interface of post 601 and/or cap member 607 to the base assembly 605, a cooperative protrusion 609 and recess 611 are provided to create a fluid tight seal.

Figure 12:
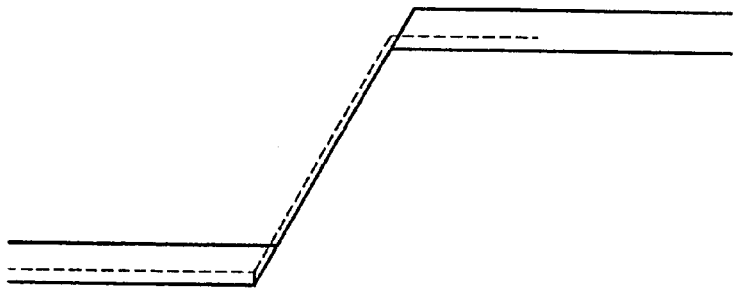
FIG. 12 is an exploded view of section A of FIG. 11 showing the fluid tight joint.

Referring now to FIG. 12, the angled surfaces of the protrusion and recess are depicted. In this manner, a fluid tight mating surface achieved. The mating surfaces may be filled with a gasket material (not shown). A further advantage of the present invention is the tolerance provided by gap 613 (FIG. 11) for thermal expansion.

Referring now to FIGS. 13 to 16, alternative embodiments for securing a graphite shaft to a graphite base without cement are provided. Particularly, in FIG. 13, a snap ring 701 is provided which is joined between corresponding grooves 702, 703 and post 704 and base respectively.

FIGS. 14, 15 and 16 depict a cam type locking mechanism which with post rotated (clockwise in this example) relative to the base until their relative eccentric diameters touch and displace the post slightly until any clearance between the previously concentric diameters is eliminated. This creates an efficient wedging together of the parts securing the post to the base. More specifically, post 801 is provided with a stepped end 803 having three different diameter sections 805, 807 and 809. Base 811 includes a bore 813 which accommodates end 803 of post 801. Base 813 includes three different diameter regions 815, 817 and 819. Section 807 and region 817 are eccentric relative to corresponding sections 805 and 809 and regions 815 and 819, respectively. In this manner, rotation of post 801 results in a wedging (see FIG. 16) of the respective sections and regions and an effective mating of the post 801 to base 811. It should also be noted that this cam locking mechanism is equally suited to a shaft impeller assembly.

Referring now to FIG. 17, a shaft to impeller/rotor arrangement 901 is depicted. Essentially, the same design using a rod and sheath as shown and discussed with respect to FIG. 1 is employed. Furthermore, the shaft could include the inner member and the outer sheath as described in the post assembly. Particularly, an impeller 903 is secured to a rod 905. Rod 905 includes cap 907 at a lower end, cap 907 being disposed within a recess 909 in impeller 903. Preferably, cap 907 will include a jagged top surface (not shown) which mates with peaks and valleys (not shown) in the upper surface of recess 909. This embodiment is suited to degassing, agitation, pumping and submergence apparatus. It should be noted that the degassing embodiment would most likely include a bore through the rod—or a sufficient gap between sheath and rod—to facilitate introduction of a reaction gas or other suitable agent.

With reference to FIG. 18, an alternate embodiment of a post 570 is shown for use in a preferred embodiment of the present invention. In this arrangement, elongated rod 510, preferably a tensor rod, is surrounded by inner member 520. Inner member 520 is preferably comprised of a compressible ceramic. Inner member 520 is surrounded by an outer sleeve 530, which is preferably a temperature/corrosion resistant ceramic. The outer sheath 530 is not affixed at the top of the structure to accommodate any thermal expansion, but is fastened at the bottom 580. The unaffixed end of outer sheath 530 is disposed within a counterbore in the housing. In addition, a gap 590 may be present between the inner member 520 and the elongated rod 510. If present, the gap 590 can be filled with a fiber or other compressible material in order to promote further heat resistance. The gap 590 may also be filled with a powder or granular material. The powder could be powdered graphite, for example. Preferably, the gap is small, however large enough so that the powder can be poured in. The gap 590 may also be at least partially filled by a liner of ceramic fiber. The liner may be adhesively sealed onto the rod 510. The liner is compressible to accommodate the thermal expansion of the rod 510. The liner or the powder that at least partially fills the gap 590 wets out any molten metal that may penetrate the protective sheath(s), protecting rod 510 by providing for example, but not limited to, a tortuous path through which any intruding molten metal must pass before reaching the rod 510. Rod 510 is affixed to motor mount 540, and tension within springs 550 is applied by nut 560 in order to maintain a bias on rod 510 and outer sleeve 530.

Another-embodiment is now shown in FIG. 19, where a molten metal pump 1001 is provided. The molten metal pump includes a base assembly 1003 having a pumping chamber 1005 with an impeller 1007 disposed therein. Bearing rings 1009 provide mating surfaces between the impeller 1007 and the base assembly 1003. Rotation of the impeller 1007 forces molten metal 1011 through outlet 1013 and up riser tube (not shown) for transport to another location.

Rotation of impeller 1007 is achieved when motor 1017 rotates shaft 1019 by turning shaft coupling 1021 provided therebetween. The motor is positioned above the base assembly 1003 on a platform assembly 1022 having an insulation layer 1023 and a motor mount plate 1025.

Post assemblies 1027, comprising a rod 1029 constructed of a heat resistant steel alloy material disposed within an outer refractory sheath 1031 and an inner protective member 1030 support the base assembly 1003 below the platform 1022. The outer sheath 1031 in this assembly may be contiguous or it may also comprise a plurality of segmented units similar to the sheath shown in FIGS. 9 and 10. Preferably, the sheath will be constructed of a ceramic of graphite such as available from Metaullics Systems Co., L.P., 31935 Aurora Road, Solon, Ohio, 44139. The lower end of rod 1029 includes cap 1035. The cap 1035 is disposed within a cavity 1037 in base assembly 1003. A graphite or refractory plug 1039 is cemented into the lowermost portion of the cavity to seal the area from molten metal. The upper end of the rod 1029 extends through the insulation layer 1023 and is secured with nut 1041. A spring assembly 1043 or other compression spring is disposed between the nut 1041 and a coupling unit or sleeve 1051. Tightening of the nut 1041 compresses the spring 1043 and biases the metallic coupling unit 1051 which in turn compresses the outer sheath 1031 toward the base assembly 1003. Other means rather than a nut could be used to provide the force to compress the spring, for example a clamp or the like.

A clamp member 1047 surrounds the metallic coupling unit or sleeve 1051. The clamp member 1047 can be a c-clamp or a clam-shell type clamp or any other suitable type clamp. A gasket may be positioned between the clamp and the coupling unit or sleeve. The gasket can be already fastened to the clamp member or it may be placed between the clamp and the coupling unit before the clamp is tightened around the coupling unit.

A bracket 1045 can act as a safety precaution in case one of the rods 1029 fail. The bracket 1045 spans the spring 1043 between the clamp 1047 and the rod 1029. The bracket can retain the spring assembly 1043 as it biases away from the base member 1003. The bracket may also act as an in-service visual indicator of rod failure. As seen in FIG. 19, the bracket 1045 spans the spring 1043. The bracket is attached at one end to the clamp 1047 and at another end to the rod 1029 by way of fastener 1049. As the nut 1041 is tightened and the spring assembly 1043 is compressed, a gap is formed along the rod between the bracket fastener 1049 and the nut 1041. Any change in measurement of this gap while the pump is in use may be indicative of a problem with the molten metal pump post 1027 or the rod 1029 more particularly.

This assembly provides a high strength steel rod connection between the base 1003 and motor mount 1022. Of course, it also protects the otherwise degradable steel rod from the molten metal environment. A further advantage is that the thermal expansion mismatch between conflicting grain directions of a graphite post and a graphite base is eliminated because the graphite member is not rigidly cemented into a hole in the base. Furthermore, the strength of the graphite sheath is increased because it is retained under compression as a result of being squeezed between metallic coupling unit 1051 and the top of base assembly 1003.

As shown in detail in FIG. 20, the end of the rod (not shown) passes through the metallic coupling unit 1051, the motor mount insulation layer 1023 and the spring assembly 1043, all of these being retained by a nut (not shown) fastened to the rod. The metallic coupling unit or sleeve 1051 is cup-shaped having a large enough diameter at its open end to receive the entire post including the protective or refractory sheath. The closed end of the cup-shaped metallic coupling unit 1051 has a central aperture (not shown) through which the rod passes. The metallic coupling unit 1051 also has a circumferential shoulder 1050 approximately midway between the open end and the closed end. Preferably, an air gap is maintained between shoulder 1050 and the top of the unit 1051 to provide temperature insulation to the Bellville springs. The metallic coupling unit allows the spring to exert a compressive force on the refractory sheath. This increases the strength of the sheath by compressing the sheath against the base assembly.

In FIG. 20, the coupling unit 1051 surrounds the periphery of the outer sheath. In an alternate embodiment, the metal coupling unit or sleeve need only at least partially surround the exterior of the outer sheath. A gasket may be interposed between the coupling unit and the outer sheath of the post. The gasket allows for thermal expansion and contraction as well as flexural movements of the outer sheath to be compensated for in the gasket. Advantageously, the coupling member allows the threaded portion of the rod to pass relatively unencumbered through the spring elements during tightening.

Likewise, the outer sheath of the post assembly may be cemented inside of the coupling unit or sleeve. The cement used is a flexible type, an example being LDS Moldable from Unifrax Corporation, Niagra Falls, N.Y. 14305. The cement also allows for the flexural movements as well as any thermal expansion of the post assembly to be controlled. Using the gasket or the flexible cement provides an area of movement inside of the coupling unit or sleeve near the top of the outer sheath and this area is where if any movement is to take place it is most desirable.

The spring assembly 1043 is positioned vertically above the metallic coupling unit 1051. The spring assembly includes a plurality of disk or Bellville-type springs 1040, two end pieces 1042, 1044 and a central tube 1046. The end pieces in the preferred embodiment are disk-shaped and the disk springs are sandwiched between them.

The first end piece 1044 attaches to the top of the central tube-1046 proximal the nut 1041 (FIG. 19). In the preferred embodiment, the first end piece is welded to the central tube to retain the disk springs. The first end piece includes a central aperture 1054 that receives the central tube.

The disk springs 1040 are positioned below the first end piece 1042. The disk springs 1040 also include central openings that receive the central tube. The springs in the preferred embodiment are not attached to the central tube so that the can move axially along the central tube as the nut is tightened.

For ease of manufacturing, the second end piece 1042 is made to the same specifications as the first end piece, however this is not required. The second end piece is situated below the disk springs 1040 and also receives the central tube 1046. Like the disk springs, the second end piece also is not attached to the central tube so that it can also move axially along the central tube as the nut is tightened. In an alternate embodiment, the second end piece or lower end piece can be permanently affixed to the central tube and the first or upper end piece can slide axially along the central tube as the nut is tightened.

As stated earlier, the central tube 1046 is received by the apertures in the end pieces and the disk springs. The central tube also includes an axial opening 1048 that receives the rod 1029 (FIG. 19). When assembled, the rod passes through the aperture in the closed end of the coupling unit 1051 and passes through the central tube 1046 of the spring assembly 1043.

Referring to FIG. 21, a portion of an alternative base assembly 1103 is shown. The base assembly 1103 has an upper surface 1105, a lower surface 1107, and a lateral surface 1109. The upper surface defines a first channel 1111 that extends through the base assembly 1103 and a counterbore 1121. The lower surface 1107 defines a second channel 1113 aligned with the first channel 1111 having a greater diameter than the first channel.

Rod 1029 includes a cap 1035 attached at its end and an annular refractory member 1091 surrounding a portion of the rod near the cap. The rod 1029 is fastened to the base 1103 by maneuvering the rod placing the cap 1035 into the second cavity 1113 while the rod and the annular refractory member 1091 slide into the first channel 1111. This can be done either by running the rod 1029 through from the lower surface 1107 or the rod can be slid into place from the lateral surface 1109. By forming clamps 1047 at appropriate positions on the motor mount, the post assembly 1027 can be slid horizontally into position during pump assembly. In this regard, the motor mount will include a laterally facing opening to accommodate the post.

Referring to FIG. 22, the channel 1111 and 1113 may be plugged by a refractory member 1069 to form a fluid-tight seal so that molten metal cannot penetrate into the channels. The refractory member can be made from graphite, ceramic or other refractory material. The refractory member 1069 can be cemented into place. The refractory member can comprise a first member 1071 that can fill channel 1113 and a second member 1073 that can fill channel 1111.

Furthermore, when the rod 1029 and the sheath 1031 are placed in tension, the outer sheath 1031 can form a fluid-tight seal in the counterbore 1021. The outer sheath can surround the rod 1029 and it annular refractory member 1091. Thus, with the refractory member 1069 and the fluid-tight seal formed by the sheath 1031 and the counterbore 1121, no molten metal should penetrate into the channels 1111, 1113.

Referring to FIG. 23, an indicating terminal 1201 may be positioned between a rod 1203 and a protective sheath 1205. The indicating terminal 1201 may be electrically connected to an indicating device 1207 at one end, however the electrical connection need not be through wires. The indicating device 1207 may have a terminal 1209 disposed in the molten metal 1211. If any molten metal 1211 were to penetrate the protective sheath 1205, the circuit connecting the indicating terminal 1201 to the indicating device 1207 would close charging the indicating device to alert an operator of the molten metal pump. In another embodiment, the indicating terminal 1201 could be placed between an inner and outer protective sheath.

Referring to FIGS. 24 and 25, post assembly 1327 comprising a rod 1329 constructed of a heat resistant steel alloy disposed within an outer refractory sheath 1331 supports a base assembly (not shown) below a platform 1322, which holds a motor (not shown). The sheath can be contiguous or it may be a plurality of segmented units similar to the sheath shown in FIGS. 9 and 10. The rod can comprise two portions, a first portion 1301 and a second portion 1303. An extension 1305 can extend upwardly from the first portion. The first portion 1301 of the rod 1329 includes an axial opening 1307, and the opening may extend through the extension 1305 if one is used. The opening 1307 receives an end of the second portion 1303 to attach the first portion to the second portion. Accordingly, if the rod includes an extension 1305, the extension also receives the second portion. The opening 1307 can include threads to attach the first portion to the second portion, however other methods of attachment may be used to attach the first portion to the second portion including pins and other locking mechanisms.

To attach the first portion to the second portion, the second portion can be screwed into the first portion. So that the first portion will not rotate with the second portion when the second portion is screwed into the first portion or when the first portion is screwed onto the second portion, the first portion includes a non-circular portion 1309 that is received by a catch 1311 having a non-circular opening 1313. The catch can be mounted on the coupling 1351 and the opening is aligned to receive the rod. The non-circular opening 1313 in the preferred embodiment is hexagonal.

In an alternate embodiment not shown in the FIGS., the second portion 1303 can include the opening and the first portion 1301 can be received inside that opening. Furthermore, the second portion may include the non-circular portion.

The two-piece rod facilitates removal and replacement of parts of the molten metal pump. To remove the motor mount assembly from the post assembly the second portion of the elongated rod can be detached, i.e. unscrewed, from the first portion. With this embodiment the motor mount does not need to be raised very far from the post assembly during disassembly of the molten metal pump.

Thus, it is apparent that there has been provided in accordance with the present invention, a molten metal pump that fully satisfies the objects, aims, and advantages as set forth above. While the invention has been described in conjunction with specific embodiments thereof, it is evident that many alternatives, modifications and variations will be apparent to those skilled in the art like of the foregoing description. Accordingly, it is intended to embrace all such alternatives, modifications and variations as fall within the spirit and broad scope of the appended claims.

The invention claimed is:

1. An assembly for mating a molten metal pump post comprising an elongated rod surrounded by a protective sheath, to a motor mount, the assembly comprising:

a hollow body member comprising an aperture shaped to receive the rod, a first end and a second end;

a cup-shaped member positioned at the second end of the hollow body member and axially aligned with the aperture, the cup-shaped member comprising an open end distal the hollow body member second end and a substantially closed end proximal the hollow body member second end, wherein the open end is shaped to receive the protective sheath and the substantially closed end comprises an opening shaped so that the elongated rod can pass through;

a clamping member at least partially surrounding the cup-shaped member; and a bracket fastened at a first end to the rod above the hollow body member first end and fastened at a second end to the clamping member.

2. The assembly of claim 1 restricting movement of the protective sheath in a direction generally parallel to a longitudinal axis of the protective sheath.

3. The assembly of claim 2, wherein the hollow body member includes a substantially planar surface including a third opening, the planar surface being configured to act against a biasing member for biasing the elongated rod.

4. The assembly of claim 3, wherein the third opening is spaced from the second opening a distance measured along a longitudinal axis of elongated rod.

5. The assembly of claim 2, wherein the second opening is non-circular.

6. The assembly of claim 1, including a biasing member disposed adjacent the assembly and configured to bias the elongated rod of the post.

* * * * *